United States Patent [19]

Blanchard

[11] Patent Number: 4,762,238

[45] Date of Patent: Aug. 9, 1988

[54] AUXILIARY HANGER ROD SUPPORT

[75] Inventor: Russell O. Blanchard, Zeeland, Mich.

[73] Assignee: Batts, Inc., Zeeland, Mich.

[21] Appl. No.: 835,196

[22] Filed: Mar. 3, 1986

[51] Int. Cl.[4] ..... B01D 25/12

[52] U.S. Cl. ..... 211/123; 211/204; 223/85

[58] Field of Search ..... 211/123, 124, 182, 113, 211/119.01, 7, 8, 204, 206; 24/556, 543, 542, 545; 248/214, 231.7, 231.8, 316.8, 340, 316.7, 316.1; 223/85

[56] References Cited

U.S. PATENT DOCUMENTS

| | | | |
|---|---|---|---|
| 692,529 | 2/1902 | Knittle | 24/543 X |
| 2,629,575 | 2/1953 | Loyot et al. | 223/85 X |
| 3,187,904 | 6/1965 | Kiechle | 211/123 X |
| 3,283,914 | 11/1966 | Robinson | 211/7 X |
| 3,456,807 | 7/1969 | D'Amato | 211/7 X |
| 3,896,931 | 7/1975 | Franklin | 223/85 X |

FOREIGN PATENT DOCUMENTS

| | | | |
|---|---|---|---|
| 1166558 | 2/1959 | Fed. Rep. of Germany | 24/487 |
| 91322 | 3/1958 | Norway | 24/487 |

*Primary Examiner*—Carl D. Friedman

*Attorney, Agent, or Firm*—Price, Heneveld, Cooper, DeWitt & Litton

[57] ABSTRACT

To discourage purloining of garment hangers from public facilities, the hangers are fabricated with support hooks having an inside opening too small to accommodate the support rods used for conventional hangers. To suspend the smaller hooks one or more auxiliary rods of substantially smaller diameter are suspended by brackets from the conventional rod.

9 Claims, 2 Drawing Sheets

AUXILIARY HANGER ROD SUPPORT

FIELD OF THE INVENTION

This invention relates to garment hangers particularly designed for use in public places where loss of the hangers is a serious problem.

BACKGROUND OF THE INVENTION

There are many situations in which garment hangers must be provided under circumstances in which the public can purloin the hangers. This causes inconvenience for subsequent would be users and replacement is a significant expense for the facility providing the hangers. Examples of such facilities include motels, hotels, restaurants, meeting halls and any other facility used by the public at which it is desirable or necessary that garment hanging equipment be provided. The problem has been aggravated by the fact that the cost of providing attendant operated garment checking facilities has become too expensive to maintain.

The problem is not new and various devices have been developed in the past in an effort to prevent hanger theft. One device has been to mount clips, one for each hanger on the support rod. Each clip has a generally horizontal leg with a slot. The hanger, instead of a hook, has an upstanding rod with a ball or short cross bar at the top too big to pass through the slot. The hanger is supported from the clip by the ball or cross rod but can be removed by sliding it out of the end of the slot. This is basically theft proof because the hanger is useless without the clips which are permanently mounted on the rod. Another device having the same objective is to equip the hangers with supports which are really eyelets entirely surrounding the support rod, making it impossible to mount or to remove the hangers except by dismounting the support rod and sliding the hangers off the end of the rod. This arrangement is very inconvenient to the user because the garments must be mounted and removed from the hangers while they remain on the support rod. Also, if a hanger is broken, replacement is a labor intensive operation.

Another approach has been forming an upturned lip or the like on the end of the hook and providing a bar which is pivoted down over the support rod and locked in place to prevent the hangers from being so manipulated that they can be lifted free of the support rod. This arrangement has the same disadvantages of the eyelet arrangement besides being complicated and expensive.

BRIEF DESCRIPTION OF THE INVENTION

This invention overcome a number of shortcomings of prior efforts to solve the hanger theft problem by rendering the hanger basically useless unless used with the special facilities provided by this invention yet retaining the convenience of a conventional hook supported hanger. It accomplishes this by the use of an auxiliary rod of a smaller diameter, in fact, too small to provide the load support necessary in a conventional clothes closet, in combination with hangers having hooks usable only with the auxiliary rod and too small to be used with a clothes rod of conventional size. Because the invention utilizes an auxiliary rod which is supported by the conventional rod, the invention can be retrofitted to existing installations.

DESCRIPTION OF THE PREFERRED EMBODIMENT

Figure 1:
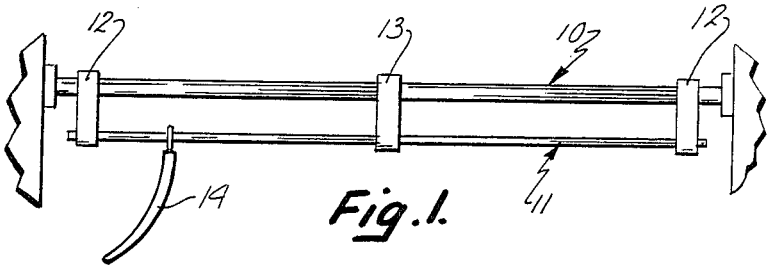
FIG. 1 is a front elevation view of the invention mounted on a clothes rod of conventional construction.

Referring to FIG. 1, the numeral 10 identifies a primary clothes rod of a conventional diameter supported at each end by any suitable means such as closet walls or the sides of a clothes rack. The nature of the end supports for the rod 10 is irrelevant to this invention. Suspended from the rod 10 is an auxiliary rod 11 by means of a pair of the brackets 12. Whether the central bracket is used depends upon the length of the rod. The diameter of the auxiliary rod 11 is substantially less than that of the main or conventional rod 10. For example, conventional rods are normally one to one and a quarter inches in diameter and are of wood, metal tubing or pipe, depending upon their length. In contrast to this, the auxiliary rod is from one-fourth to one-half inch in diameter and has to be rigid metal rod or tubing capable of withstanding the weight of clothing without significant deflection. A preferred size is three-eights of an inch. The hangers 14 used with this invention are suspended from the auxiliary rod 11. Because the auxiliary rod is substantially smaller in diameter than the conventional rod it cannot support the same weight of clothes as a conventional rod. To overcome this, one or more intermediate brackets 13 may be used to reduce the effective span. The hangers can be wooden or molded of suitable plastic materials such as polypropylene or styrene.

Figure 4:
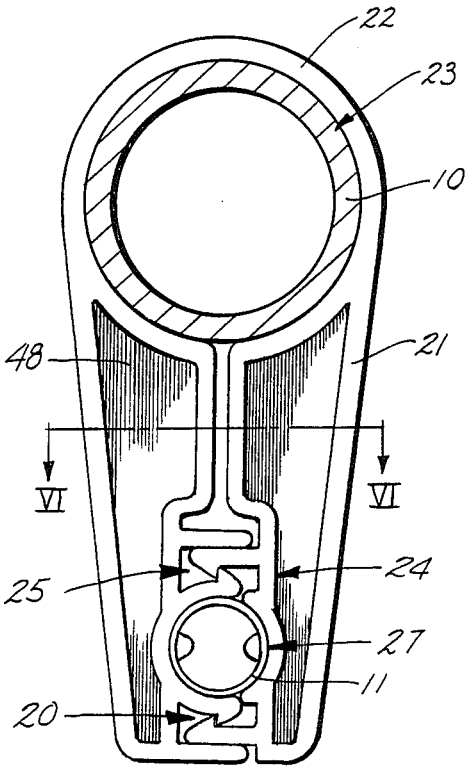
FIG. 4 is an end view of the bracket in closed position.

The brackets 12 can be molded in one piece from suitable plastic materials such as nylon, acetal or delrin and, as molded, are generally of U-shape. The legs 20 and 21 are joined by web 22 which, when the bracket is closed, forms an aperture or socket 23 preferably designed to seat closely about the conventional clothes rod 10 (FIG. 4). Adjacent the free ends of the legs, the brackets have a latch 24 including upper and lower spaced latch elements 25 and 26, which when the bracket is closed, form a lower aperture or socket 27 (FIG. 4) of a size to receive and closely seat about the auxiliary rod or tube 11.

The upper latch element 25 on the leg 20 has a pair of fingers 28 and 29 separated by a slot 30. The lower finger has a locking tooth 31 extending into the slot 30. The lower latch element 26 on the leg 20 is of the same construction, having a pair of fingers 32 and 33 defining a slot 34 between them. The upper finger has a locking tooth 35 extending into the slot 34. The only difference between the upper and lower latch elements is that the teeth extend in opposite directions.

The leg 21 has upper and lower fingers 38 and 39 of a size, shape and spacing to seat in the slots 30 and 34 respectively. The fingers each have a tooth 40 or 41, respectively designed to interlock with the teeth 31 and 35 on the fingers 28 and 32 respectively. The teeth are so designed that once engaged they cannot be separated without specialized tools designed specifically for that purpose. The presence of the auxiliary rod 11 in the socket 27 provides rigid support for the latches 25 and 26 positively preventing separation without the tool. Between the fingers 38 and 39 a concave rod seat 42 is provided to positively position the auxiliary rod 11.

Figure 2:
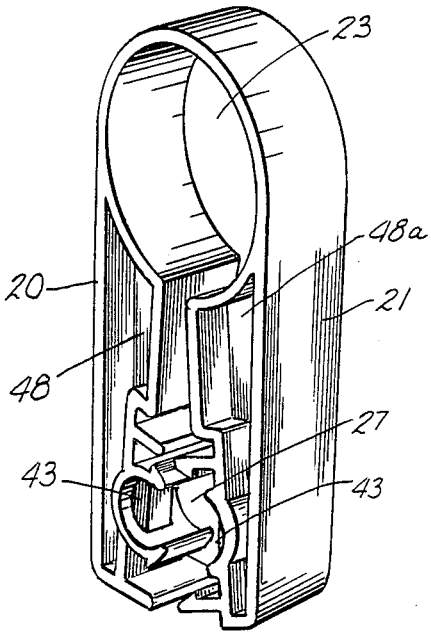
FIG. 2 is an oblique view of an auxiliary rod mounting bracket of this invention, illustrated in open position.
Figure 3:
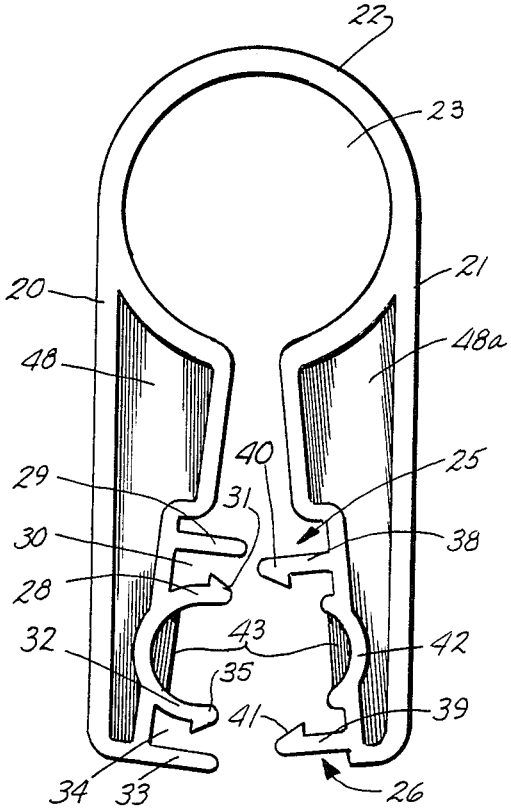
FIG. 3 is an end view of the bracket in open position.
Figure 5:
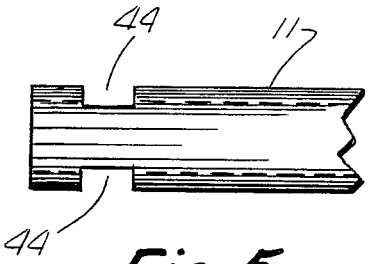
FIG. 5 is a top fragmentary view a typical end of the auxiliary rod.

The bracket illustrated in FIGS. 2 and 3 has a key 43 extending into the socket 27 from each of the legs 20 and 21. The keys 43 are designed to seat in openings such as the key slots or holes 44 provided on both sides of the auxiliary rod adjacent both ends of the auxiliary rod to prevent both axial and rotational movement of the rod 11. The rod 11 illustrated in FIG. 5 has the openings diametrically positioned at both ends. In addition, it may have similar openings at the center to accommodate the central bracket 13. However, if the keys 43 are omitted from the central bracket, this would be unnecessary. This is feasible because a key/slot arrangement at the central bracket is basically redundant.

FIG. 4 illustrates the fact that the bracket, when closed and the latches secured can be made to clamp tightly about the primary or conventional rod 10. Preferably, the brackets are made in a range of sizes to accommodate clothes rods of the more commonly used diameter such as those in the range of one to one and three-eights inches for which the hooks of conventional hangers are designed. A close fit can be maintained between the brackets and the auxiliary rod 11, since this rod is provided in a single diameter.

Figure 6:
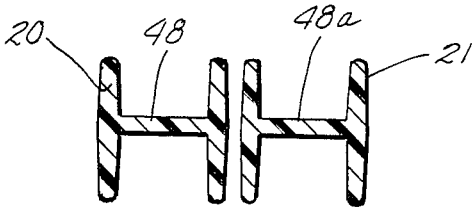
FIG. 6 is a sectional view taken along the plane VI—VI of FIG. 4.

The sides of the socket 27 are prevented from being wedged apart to release the auxiliary rod by the central webs 48 and **48*a* which interconnect the inner and outer flanges of each of the legs (FIG. 6**). This design provides the legs of the bracket with the rigidity of an I-beam construction.

Figure 7:
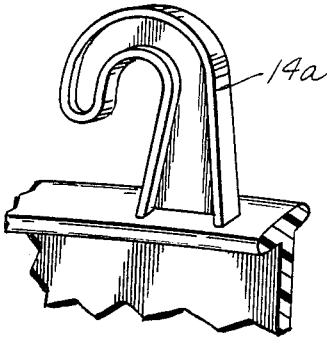
FIG. 7 is a fragmentary oblique view of a hook incorporating this invention.
Figure 8:
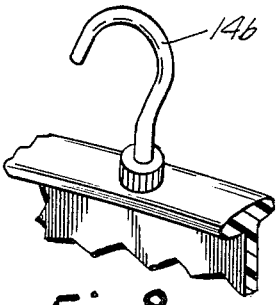
FIG. 8 is a view similar to FIG. 7 illustrating a different construction for the hook.
Figure 9:
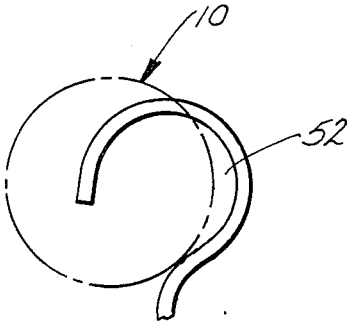
FIG. 9 is a schematic view illustrating the size relationship between the hook of this invention and a conventional clothes rod.

That this invention will discourage purloining of the individual hangers is illustrated in FIG. 9 which contrasts the size of the hook opening 52 of a garment hanger 14 incorporating this invention with the diameter of a conventional clothes rod 10. The hook can be of any suitable material such as molded plastic (hook **14*a*, FIG. 7) or wire (hook 14*b*, FIG. 8**). The construction of the body of the hanger is not affected by this invention and remains conventional such as wood, plastic or formed metal rod.

The invention is effective in discouraging theft by making the hangers useless in the absence of the auxiliary rod and brackets. Because the hangers can only be used with the small diameter rod, the hangers alone, without both the auxiliary rod and brackets, are useless. Substituting for the conventional rod, a rod of the diameter of the auxiliary rod is also useless because it cannot support the weight of the garments across the span of a normal closet, even a relatively small closet. Because the bracket design is such as to require a special tool to open or release it, the brackets are basically theft proof.

The spacing between the primary or conventional rod 10 and the auxiliary rod 11 need be no more than enough to permit the hooks 14 to be passed between them. This makes it possible to so space the rods that hooks of more conventional hangers can be mounted on the conventional rod without interference from the auxiliary rod. This will also permit such heavy items as garment bags to be supported on the conventional rods without preventing use of the auxiliary rod and hooks.

Having described a preferred embodiment of this invention together with modification thereof, it will be recognized that other modifications can be made without departing from the principles thereof. Such modifications are to be considered as included in the hereinafter appended claims, unless the language of the claims expressly states otherwise.

I claim:

1. Means for simultaneously providing support for garment hangers of conventional construction and providing for discouraging the unauthorized removal of specially designed open hook supported garment hangers from their location of use, said means comprising: a garment hanger support rod of conventional diameter and an auxiliary support rod of a substantially small diameter than that of said conventional garment hanger support rod; a pair of brackets one mounted to said auxiliary support rod at each of its ends, each of said brackets having means for engaging the garment hanger support rod of conventional diameter to suspend the auxiliary support rod beneath the conventional support rod in closely spaced vertical relationship thereto; said bracket initially being of an inverted generally U-shape with a pair of depending legs forming an upwardly extending aperture therebetween defining a first cavity for receiving said conventional garment hanger support rod adjacent the top of the bracket, said aperture also defining a second concave cavity in each leg adjacent the open end thereof, said second aperture being of a size when said legs are brought together to snugly receive said auxiliary rod therein; latch means for holding said legs together with said rods in their respective cavities; said auxiliary rod and said brackets having interengaging means for holding the auxiliary rod against both axial and rotational movement with respect to said brackets; said interengaging means being a key integral with said bracket and projecting into said second aperture and a key receiving opening in one side of said auxiliary rod; said key being narrower than said bracket and recessed from both ends of said second aperture and said key receiving opening being only wide enough to receive said key whereby said keys are concealed within said bracket when it is closed around said auxiliary rod; a garment hanger having a support hook, said hook having a rod receiving opening of a size no larger than that necessary to receive the auxiliary rod therein.

2. The means described in claim 1 wherein said interengaging means is a pair of keys integral with said bracket projecting into and positioned diametrically of said second aperture and a pair of diametrically positioned key receiving openings in said auxiliary rod.

3. The means described in claim 2 wherein said keys and key receiving openings are provided at both ends of said auxiliary rod to prevent release from said brackets from either end of said auxiliary rod; said keys being narrower than said brackets and recessed from both ends of said second aperture and said key receiving openings are only wide enough to receive said keys.

4. The combination described in claim 1 wherein each of said brackets has means preventing its disengagement from the conventional support rod in the absence of a special tool for disengagement of the support rod from its support, said means including two pairs of interlocking latch elements, one latch element of each pair having a face forming part of said second aperture, the other of the latch elements of each pair engaging the face of said one latch element of the same pair opposite from said aperture and a finger member spaced from each of said one latch elements forming a slot of a size to receive and closely embrace the other latch element of each pair.

5. In combination, a primary garment hanger support rod of conventional diameter and an auxiliary support rod of substantially smaller diameter than that of said conventional garment support rod; a pair of spaced brackets mounted on said conventional support rod; said auxiliary support rod mounted on and suspended between said brackets beneath said primary support; garment hangers each having an open support hook, said hooks having a rod receiving opening of a size only large enough to receive and seat the auxiliary rod therein; auxiliary rod engaging means on said brackets for holding said auxiliary rod against both axial and radial movement; said brackets each having interlocking means preventing said brackets from being disengaged from said auxiliary rod; said brackets being elongated for spacing said auxiliary rod from said conventional rod a distance only sufficient to permit said hooks to pass between them.

6. The combination described in claim 5 wherein said brackets are sufficiently elongated to permit the rod hooks of garment bags to be supported on the conventional support rod without interference by the auxiliary rod with the garment bag suspended beneath said auxiliary rod.

7. The combination described in claim 5 wherein said brackets are of a length such that hangers having support hooks of conventional size can be mounted on said primary rod without removal of said auxiliary rod and with the garments thereon suspended below said auxiliary rod.

8. In combination, a primary garment hanger support rod of conventional diameter and an auxiliary support rod of substantially smaller diameter than that of said conventional garment support rod; a pair of spaced brackets mounted on said conventional support rod; said auxiliary support rod mounted on and suspended between said brackets beneath said primary support; garment hangers each having an open support hook, said hooks having a rod receiving opening of a size only large enough to receive and seat the auxiliary rod therein; auxiliary rod engaging means on said brackets for holding said auxiliary rod against axial movement; said brackets being elongated for spacing said auxiliary rod from said conventional rod a distance only sufficient to permit said hooks to pass between them; said brackets having interlocking bracket closure members for holding the brackets in closed primary and secondary rod clamping position; said brackets also having fingers overlying said interlocking members when said brackets are closed for holding said interlocking members against separation and release.

9. Means for simultaneously providing support for garment hangers of conventional construction and providing for discouraging the unauthorized removal of specially designed open hook supported garment hangers from their location of use, said means comprising: a garment hanger support rod of conventional diameter and an auxiliary support rod of a substantially small diameter than that of said conventional garment hanger support rod; a pair of brackets one mounted to said auxiliary support at each of its ends, each of said brackets having means for engaging the garment hanger support rod of conventional diameter to suspend the auxiliary support rod beneath the conventional support rod in closely spaced vertical relationship thereto; a garment hanger having a support hook, said hook having a rod receiving opening of a size no larger than that necessary to receive the auxiliary rod therein; said brackets each being capable of being opened at one end to receive said conventional and auxiliary support rods and interlocking means holding them closed after the rods have been placed therein; said brackets having auxiliary rod engaging means holding the auxiliary rod against axial movement.

* * * * *